US005475910A

United States Patent [19]

Yamamoto

[11] Patent Number: 5,475,910

[45] Date of Patent: Dec. 19, 1995

[54] JEWEL SETTING METHOD

[76] Inventor: Katsumi Yamamoto, 19-16, 4-chome, Kaminoge, Setagaya-ku, Tokyo, Japan

[21] Appl. No.: 309,649

[22] Filed: Sep. 21, 1994

[30] Foreign Application Priority Data

| | | | |
|---|---|---|---|
| Sep. 28, 1993 | [JP] | Japan | 5-241021 |
| Feb. 7, 1994 | [JP] | Japan | 6-013619 |
| Aug. 19, 1994 | [JP] | Japan | 6-195187 |

[51] Int. Cl.[6] ..... B23P 5/00

[52] U.S. Cl. ..... 29/10; 29/110.6; 63/26

[58] Field of Search ..... 29/10, 160.6; 63/26, 63/27, 28

[56] References Cited

U.S. PATENT DOCUMENTS

| | | | |
|---|---|---|---|
| 1,499,818 | 7/1924 | Franconetti | 29/10 |
| 3,261,072 | 7/1966 | Stanley | 29/160.6 |
| 5,218,839 | 6/1993 | Udko | 63/26 |

FOREIGN PATENT DOCUMENTS

| | | |
|---|---|---|
| 62-9914 | 1/1987 | Japan . |
| 63-191916 | 12/1988 | Japan . |

*Primary Examiner*—P. W. Echols

*Attorney, Agent, or Firm*—Nikaido, Marmelstein, Murray & Oram

[57] ABSTRACT

A jewel setting method comprising the steps of: making a hole in an elastic object; forming overhangs around the top circumference of the hole; and press-fitting a jewel into the hole by causing the overhangs to be yieldingly withdrawn, allowing the girdle of the jewel to pass through the space delimited by the surrounding overhangs, and then, allowing the overhangs to return to their original positions, thereby catching the bezel of the jewel. Examples of such materials are plastic, ivory, horn, wood and metal.

9 Claims, 6 Drawing Sheets

JEWEL SETTING METHOD

BACKGROUND OF THE INVENTION

1. Field of the Invention

The present invention relates to a method of setting jewels in certain objects for ornamental purposes, particularly setting jewels in objects of plastic or the like in a firm and sure manners.

2. Description of Related Art

Jewel setting methods are shown for instance in Japanese Utility Models 62-9,914(A) and 63-191,916(A).

In the former publication a through hole is made in a metal object; the inner wall of the through hole is enlarged circumferentially at a level just below the top circumference of the through hole, thus forming a circumferential seat; a jewel is inserted in the through hole until its girdle is put on the circumferential seat; and the top circumference of the through hole is hammered to extend and overhang the jewel, thus holding the jewel by its bezel.

In the latter publication a through hole is made in a metal object; the through hole is enlarged around its top circumference; a jewel is put in the through hole; and the enlarged circumference of the through hole is pressed against the bezel of the jewel, thus holding the jewel by its bezel.

These jewel setting methods require the hammering or pressing of the metal object around the opening in which the jewel is inserted, and therefore, these methods cannot be applied to objects of materials other than metals. Also, minute, precise works are required in setting jewels in metal objects, and accordingly the working efficiency is lowered, and the jewel-setting cost is high.

In setting jewels in plastic, adhesives are used to fix jewels in the holes made in such non-metal objects. Such adhesives, however, are liable to lose adhesion with age. It may happen that jewels fall out from the holes of an object when subjected to an impact, as for instance when the object falls on the floor.

Therefore, there has been an increasing demand for efficiently setting jewels in objects of plastic and other materials.

SUMMARY OF THE INVENTION

One object of the present invention is to provide a jewel setting method to meet such demand, permitting the setting of jewels in objects of plastic and other materials at an increased efficiency.

To attain this object a method of setting at least one jewel in an object which is of a material capable of returning to its original shape and size after being deformed, is improved according to the present invention in that it comprises the steps of: making in the object, a hole which corresponds to the jewel in shape, but is somewhat smaller than the jewel; making a circumferential slot on the inner wall of the hole just below the top circumference of the hole opening; and press-fitting the jewel in the hole by causing the hole to yieldingly expand and then, by allowing the hole to substantially return to its original shape and size, thus causing the jewel to be caught in the circumferential slot on the inner wall of the hole.

The material is flexible enough to allow the jewel to fit in the hole by causing the hole to yieldingly enlarge and then, allowing the hole to return to its original shape and size after being deformed to snugly accommodate the jewel therein.

Also, a jewel setting method according to another aspect of the present invention comprises the steps of: forming a plurality of projections on the circumference of a hole which is to be made in the object; making in the object, a hole which corresponds to the jewel in shape, but is somewhat smaller than the jewel; and press-fitting the jewel in the hole by causing the projections to be yieldingly withdrawn and then, allowing them to substantially return to their original positions, thus causing the jewel to be caught by the circumferential projections around the hole. These projections may be bosses or round ornaments rising from the surface of the object, and may be arranged so as to hold jewels side by side. Such projections arranged around the hole are effective in radially enlarging the hole, thereby facilitating the press-fitting of the jewel in the hole. Thus, the jewel can be easily set in an object which is made of a relatively rigid material.

Also, a jewel setting method according to still another aspect of the present invention comprises the steps of: forming an annular projection on the circumference of a hole which is to be made in the object; making in the object, a hole which corresponds to the jewel in shape, but is somewhat smaller than the jewel; and press-fitting the jewel in the hole by causing the annular projection to yieldingly expand and then, allowing it to substantially return to its original shape and size, thus causing the jewel to be caught by the annular ring around the hole. In this case same effects as discrete projections are caused.

The material may be plastic, ivory, horn, wood and metal.

The circumference of the hole made in the object particularly of rigid plastic may be heated until it is softened, and then the jewel is press-fitted therein. The heating can be effected by dipping the object in boiled water, dropping heated oil onto the circumference of the hole or blowing steam against it.

Other objects and advantages of the present invention will be understood from the description as to how a jewel or jewels can be set in an object according to preferred embodiments of the present invention, which description is made with reference to accompanying drawings.

DESCRIPTION OF THE PREFERRED EMBODIMENTS

Figure 1:
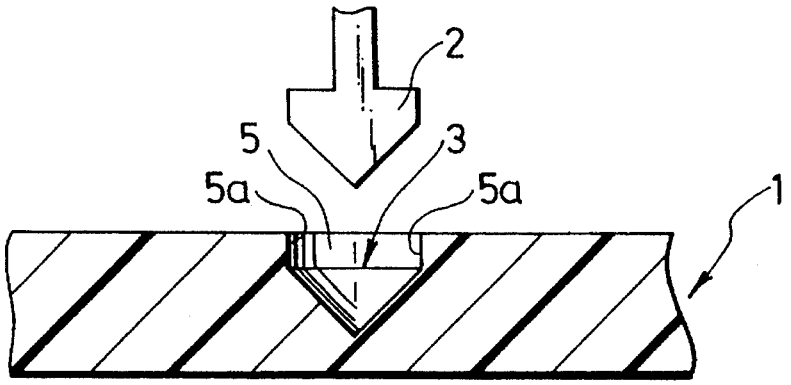
FIG. 1 is a longitudinal section of an object, diagrammatically showing how it is processed at the first step of a first embodiment of the present invention.
Figure 2:
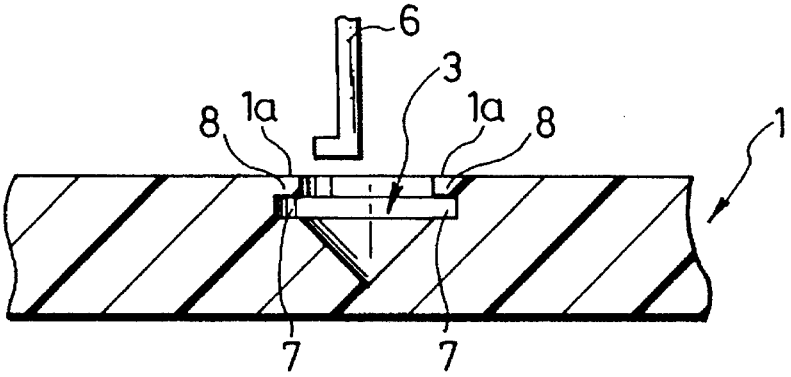
FIG. 2 is a similar longitudinal section, diagrammatically showing how the object is processed at the second step.
Figure 3:
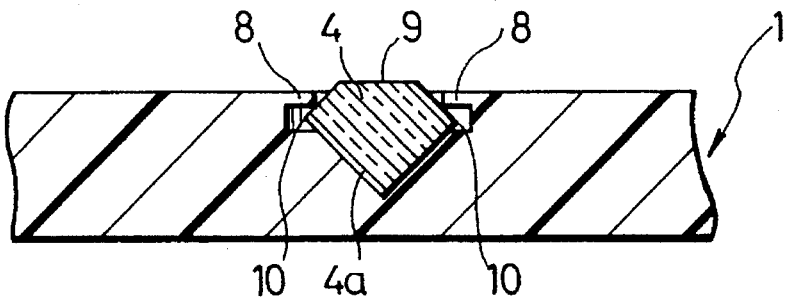
FIG. 3 is a longitudinal section, but showing how the jewel is mounted in the object according to the first embodiment.

Referring to FIGS. 1 to 3, a jewel setting method according to a first embodiment of the present invention is described. An object 1 is made of a plastic material of certain rigidity at normal temperature. Also, it is somewhat soft, and is capable of returning to its original shape and size after being deformed.

At first stage a conical hole 3 is made in the plastic object by using a drill bit 2. The hole 3 has a shape corresponding to the shape, particularly the pavilion of a jewel 4 to be mounted, but the hole 3 has a diameter somewhat shorter than the maximum diameter or girdle of the jewel 4 as viewed from the top of the jewel 4. The jewel 4 is assumed to be a brilliant-cut diamond. The drill bit 2 has a conical shape corresponding to the lower part or pavilion of the brilliant-cut diamond to be mounted.

Referring to FIG. 2, an angle drill bit 6 is used to make a circumferential slot 7 on the inner wall 5*a* of the hole 5 just below the top circumference 1*a* of the hole 5, thus forming an engagement edge 8 radially projecting in the form of overhang. The circumferential slot 7 thus made has a diameter somewhat larger than the girdle of the jewel.

The pavilion 4*a* of the jewel 4 is applied in the convergent surface of the hole 5, and a force is applied evenly to the table 9 of the jewel 4, thereby pushing the jewel 4 into the hole 5 by causing the top opening area to yieldingly expand, and by allowing the top opening area to return to its original shape and size after the girdle 10 of the jewel 4 has passed through the enlarged opening area. Then, the bezel of the jewel 4 is covered by the circumference of the hole, thereby positively mounting the jewel 4 in the object 1, as seen from FIG. 3.

Figure 4:
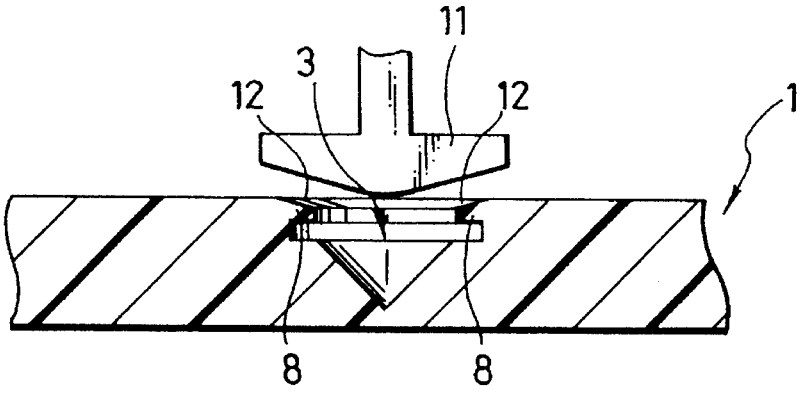
FIG. 4 is a longitudinal section of an object, diagrammatically showing how it is processed at the third step of a second embodiment of the present invention.
Figure 5:
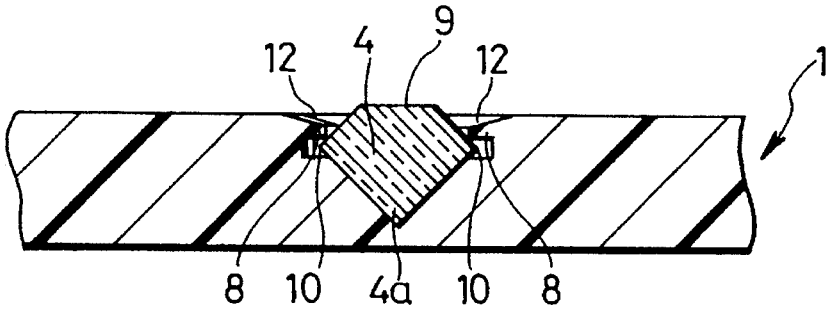
FIG. 5 is a longitudinal section, but showing how the jewel is mounted in the object according to the second embodiment.

Referring to FIGS. 4 and 5, a jewel setting method according to a second embodiment of the present invention is described. A hole which is similar to the hole as shown in FIG. 2 is made in an object 1, and then a drill bit 11 is used to chamfer the circumference of the top of the hole 3, thereby providing a chamfered circumference 12, which is effective in increasing the flexibility of the circumference of the top of the hole, and at the same time, improving the sliding of the pavilion of the jewel 4 along the radial overhang 8 of the hole 3. Thus, the mounting of the jewel 4 in the hole 3 of the object 1 is facilitated.

Figure 6:
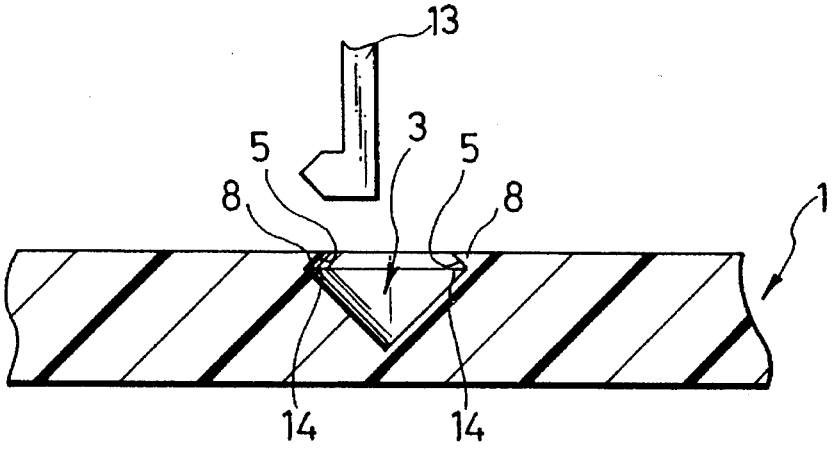
FIG. 6 is a longitudinal section, diagrammatically showing how the object is processed at the second step of a third embodiment of the present invention.
Figure 7:
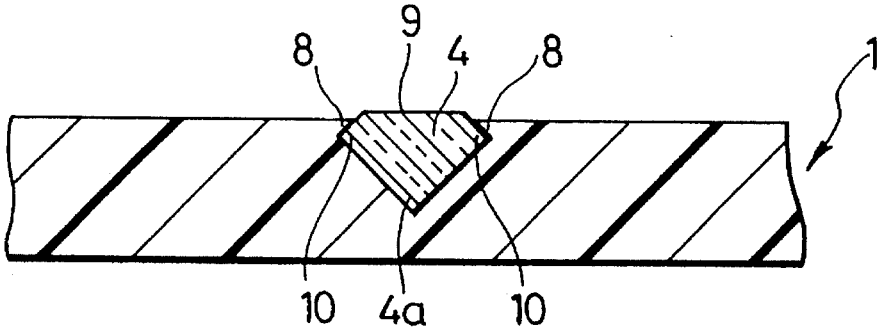
FIG. 7 is a longitudinal section, but showing how the jewel is mounted in the object according to the third embodiment.
Figure 8:
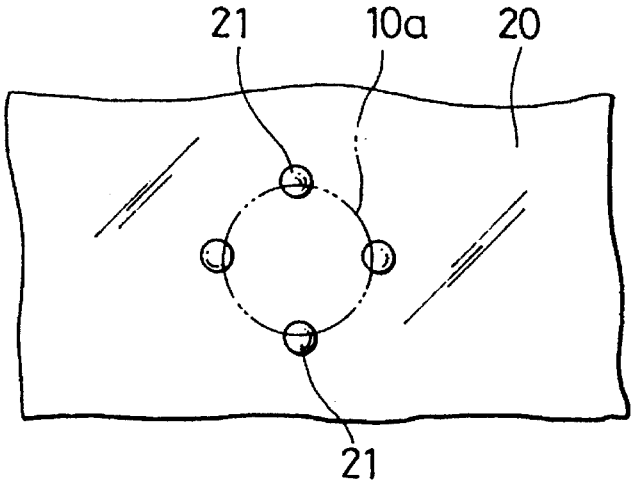
FIG. 8 is a longitudinal section of an object, diagrammatically showing how it is processed at the first step of a fourth embodiment of the present invention.
Figure 9:
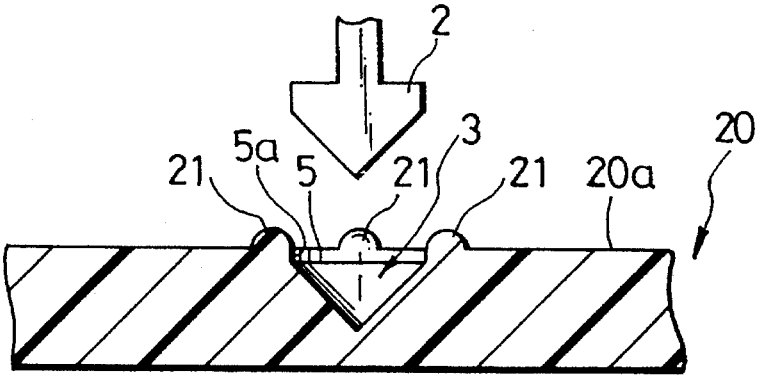
FIG. 9 is a similar longitudinal section, diagrammatically showing how the object is processed at the second step.
Figure 10:
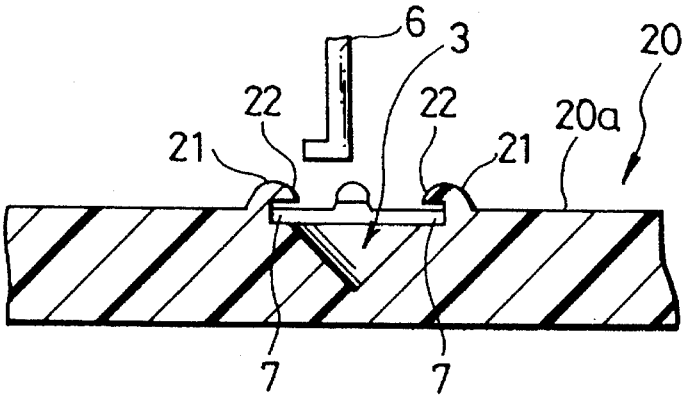
FIG. 10 is a longitudinal section, diagrammatically showing how the object is processed at the third step.

Referring to FIGS. 6 and 7, a jewel setting method according to a third embodiment of the present invention is described. In these drawings same parts as in FIGS. 1 to 5 are indicated by same reference numerals as used in FIGS. 1 to 5.

After making a hole 3 similar to the hole 3 in FIG. 1, a drill bit 13 is used to make a V-shaped slot 14 on the inner wall surface of the hole 3 just below the top circumference 5 of the hole 3, thereby forming an acute-edged overhang 8 to catch the bezel of the jewel 4.

In this particular embodiment the difference between the diameter of the acute-edged overhang 8 and the diameter of the girdle 10 of the jewel 4 is larger than those in the first and second embodiments, but the object 1 is of a synthetic resin which is flexible enough to allow the opening area 8 to yieldingly expand, thereby allowing the jewel 4 to pass therethrough. The opening area will return to its original shape and size, thereby causing the top circumference of the hole to cover the bezel 10 of the jewel 4, thus positively holding the jewel 4 in the hole 3 of the object 1.

Referring to FIGS. 8 to 11, a jewel setting method according to a fourth embodiment of the present invention is described. An object 20 is made of a rigid plastic material, which is, however, capable of returning to its original shape and size after being somewhat deformed. As seen from FIG. 8, four round projections 21 are formed on a circle corresponding to the girdle of a jewel to be mounted in the object 20.

A hole 3 is made in the area encircled by these four bosses 21. The hole 3 thus made has a diameter somewhat shorter than the diameter of the girdle of the jewel 4.

An angle drill bit 6 is used to make a circumferential recess 7 on the inner wall 5*a* of the hole 5, thus forming the overhangs 22 between the recess 7 and the bosses 21. The circumferential recess 7 has a diameter somewhat larger than the diameter of the girdle of the jewel 4. Thus, the overhangs 22 are formed at a level somewhat higher than the top surface 20*a* of the object 20, as seen from FIG. 10.

Figure 11:
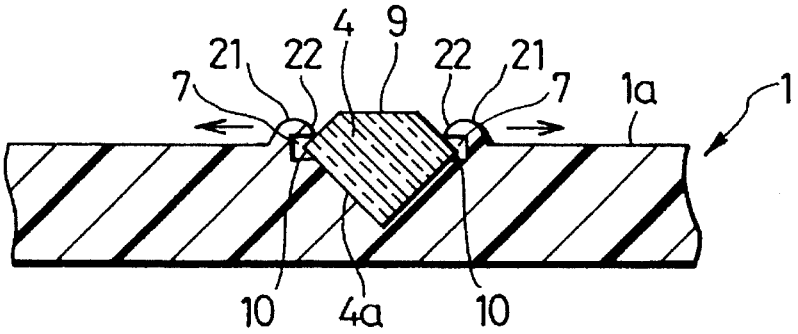
FIG. 11 shows how the jewel is mounted in the object according to the fourth embodiment.

The jewel 4 can be press-fitted in the hole 3 by causing the overhangs 21 to yieldingly bend backward as indicated by arrows in FIG. 11, thereby expanding the top opening area wide enough to allow the girdle of the jewel 4 to pass therethrough. The discrete bosses are easily bent by applying a reduced force thereto, thus facilitating the mounting of the jewel in the object.

The circumferential arrangement of elastically deformable overhangs permits the mounting of a jewel in an object even if made of a relatively rigid material. The rising overhangs 21 put the table 9 of the jewel 4 at a higher level above the top surface 20*a* of the object 20, thus providing a pleasing appearance.

Figure 12:
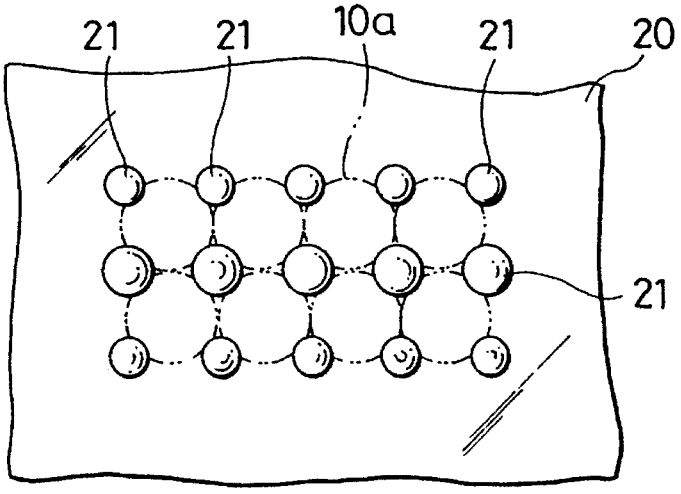
FIG. 12 is a plane view of a selected part of an object, diagrammatically showing how it is processed at the first step of a fifth embodiment of the present invention.
Figure 13:
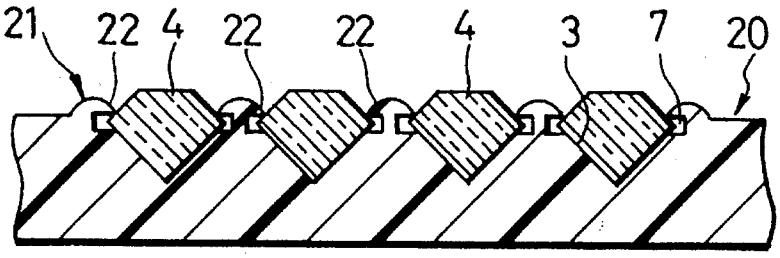
FIG. 13 is a longitudinal section, but showing how the jewels are mounted in the object according to the fifth embodiment.
Figure 14:
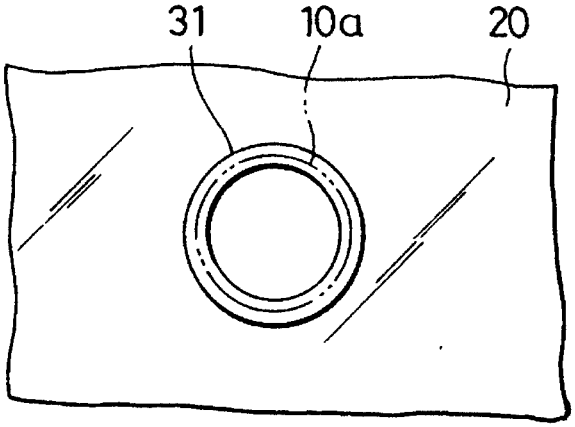
FIG. 14 is a plane view of a selected part of an object, diagrammatically showing how it is processed at the first step of a sixth embodiment of the present invention.

Referring to FIGS. 12 and 13, a plurality of jewels 4 are set side by side according to the fourth embodiment of the present invention.

As shown in FIG. 12, a plurality of bosses 21 are formed at the crossings of a lattice in an object 20, and a hole 3 is made in each space delimited by every set of four bosses.

Then, a circumferential recess 7 is made to form overhangs 22 around each hole 3. Jewels 4 are press-fitted in these holes 3 one after another, thus mounting the jewels 4 side by side in the object 20.

Referring to FIGS. 14 to 17, a jewel setting method according to a sixth embodiment of the present invention is described. An object 30 has a crater-like hole 3. It is different from the hole in FIG. 11 only in that it has an annular projection in place of discrete projections. Specifically, a plastic object 30 has an annular projection 31 corresponding to the girdle 10*a* of a jewel to be mounted. The annular projection 31 can be integrally formed on the plastic object for instance, by injection molding.

Figure 15:
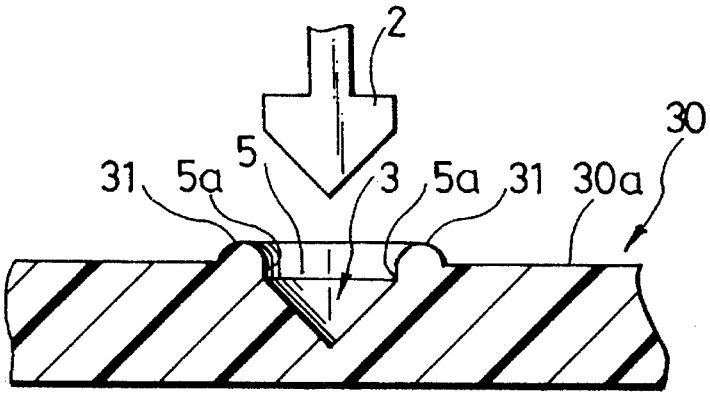
FIG. 15 is a longitudinal section, but showing how it is processed at the second step.
Figure 16:
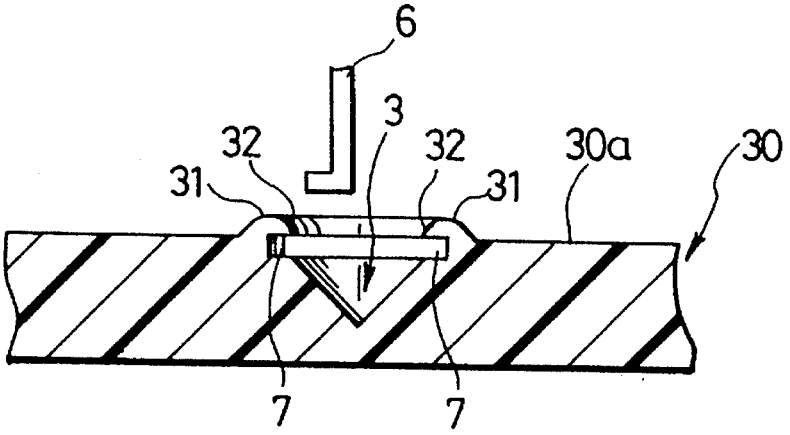
FIG. 16 shows how it is processed at the third step.
Figure 17:
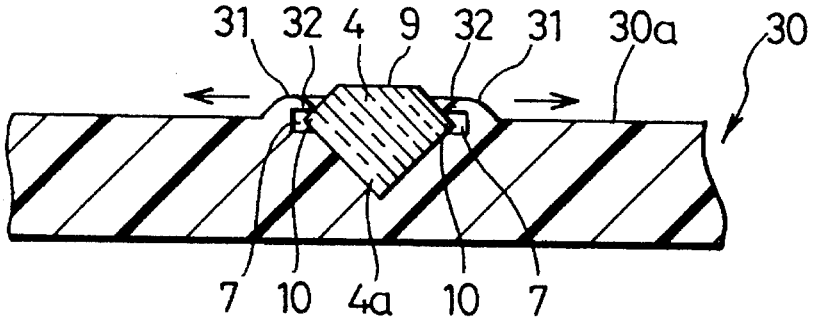
FIG. 17 shows how the jewel is mounted in the object according to the sixth embodiment.

As seen from FIG. 15, a conical hole 3 is made in the annular projection 31 by using a drill bit 2. The hole 3 has a diameter somewhat shorter than the girdle of a jewel 4 to be mounted. Then, a circumferential slot 7 is made on the inner wall 5*a* of the hole 3 by using an angle drill bit 6, thus forming overhangs 32 between the circumferential slot 7 and the annular projection 31. The circumferential slot 7 has a diameter somewhat larger than the diameter of the girdle of the jewel 4 to be mounted. Thus, the annular overhang 32 is formed at a level somewhat higher than the top surface 30*a* of the object 30, as seen from FIG. 16.

The jewel 4 can be mounted in the object in the same way as in the embodiments above described. Specifically, the annular overhang 32 is yieldingly bent outward as indicated by arrows in FIG. 17, thereby allowing the girdle of the jewel 4 to pass therethrough. Then, the annular overhang 32 returns to its original shape and size to catch the bezel of the jewel 4, thereby holding the jewel 4. In this particular embodiment the continuous overhang 32 encircling the top opening area 5 can hold the jewel 4 with an increased stability.

In all embodiments described above the material of the object is flexible enough to allow a jewel to pass through its opening circumference at normal temperature. If the material is too rigid to permit the passing of a jewel through its opening circumference at normal temperature, the object is heated to be deformable enough to permit the passing of the jewel through its opening circumference. Thus, objects of a thermoplastic resin such as nylon resin or vinyl chloride can be used.

In case that such thermoplastic resin objects are used, boiled water or heated oil at the temperature ranging from 70° C. to 100° C. are dropped onto the overhangs encircling the hole of each object, or heated steam is blown directly thereto until they are softened. Then, a jewel is press-fitted in the hole, and the water or oil is removed from the object.

According to this embodiment jewels can be mounted in objects even if their overhangs are relatively thick.

Figure 18:
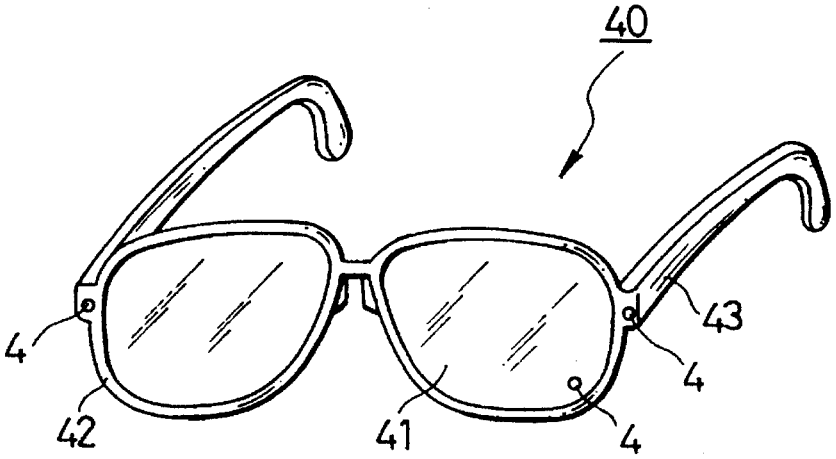
FIG. 18 is a perspective view of an eye glass whose lens and rim have jewels set according to the present invention.

Referring to FIG. 18, jewels 4 can be set in the lenses 41, the rim 42 or the bow 43 of an eyeglass 40. Likewise, jewels can be set in ball-pointed pens, fountain pens, compacts, perfume atomizers, cosmetic tools, plastic articles or glass articles.

As may be understood from the above, a jewel setting method according to the present invention permits the mounting of jewels in objects of plastic and other materials which are capable of returning to their original shapes and sizes after being deformed, requiring neither hammering nor pressing. Thus, jewels can be set in objects at an increased efficiency, and accordingly the jewel-setting cost can be lowered. Examples of such materials are plastic, ivory, horn, wood and metal.

I claim:

1. A method of setting at least one jewel in an object which is of an elastic material comprising the steps of:

making in the object, a hole which corresponds to the jewel in shape, but is somewhat smaller than the largest diameter of the jewel; making a circumferential slot on the inner wall of the hole just below the top circumference of the hole opening, the slot having a diameter larger than the largest diameter of the jewel; and press-fitting the jewel in the hole by causing the outer perimeter of the hole to be yieldingly enlarged and then, allowing the perimeter of the hole to return to its original shape and size, thus causing the jewel to be caught in the circumferential slot on the inner wall of the hole.

2. A method according to claim 1 wherein said material is flexible enough to allow the jewel to fit in the hole by causing the perimeter of the hole to be yieldingly enlarged and then, allowing the perimeter of the hole to return to its original shape and size after accommodating the jewel therein.

3. A method according to claim 1, or 2 wherein said material is plastic, ivory, horn, wood or metal.

4. A method according to claim 1 wherein it further comprises a step of heating the circumference of the hole before press-fitting the jewel therein.

5. A method according to claim 4 wherein said material is plastic.

6. A method of setting at least one jewel in an object which is of an elastic material comprising the steps of:

forming a plurality of projections on the circumference of a position where a hole is to be made in the object;

making in the object, a hole which corresponds to the jewel in shape, but is somewhat smaller than the largest diameter of the jewel;

making a circumferential recess at least in part in an inner wall of the hole and in an inner wall surface of said projections, the recess having a diameter larger than the largest diameter of the jewel; and press-fitting the jewel in the hole by causing the projections to be yieldingly withdrawn and then, allowing them to return to their original position, thus causing the jewel to be caught by the recess in the circumferential projections around the hole.

7. A method according to claim 6 wherein said projections are bosses or round ornaments rising from the surface of the object.

8. A method according to claim 6 wherein said projections are arranged so as to hold jewels side by side.

9. A method of setting at least one jewel in an object which is of an elastic material comprising the steps of:

forming an annular projection on the circumference of a position where a hole is to be made in the object;

making in the object, a hole which corresponds to the jewel in shape, but is somewhat smaller than a largest diameter of the jewel;

making a circumferential slot at least in part in an inner wall of the hole and in an inner wall surface of said annular projection, the slot having a diameter larger than the largest diameter of the jewel;

press-fitting the jewel in the hole by causing the annular projection to be yieldingly expanded; and allowing said annular projection to return to its original shape and size, thus causing the jewel to be caught by the annular ring around the hole.

* * * * *